US005971313A

United States Patent [19]

Krayenhagen

[11] Patent Number: 5,971,313

[45] Date of Patent: Oct. 26, 1999

[54] APPARATUS FOR EQUALIZING TENSION IN A TRAVELING WEB

[75] Inventor: Everette D. Krayenhagen, Charlotte, N.C.

[73] Assignee: Eridan International, Inc., Charlotte, N.C.

[21] Appl. No.: 09/111,966

[22] Filed: Jul. 8, 1998

[51] Int. Cl.[6] ..... B65H 23/00

[52] U.S. Cl. ..... 242/417.3; 242/419; 242/615.1; 226/18

[58] Field of Search ..... 242/417.3, 419, 242/419.1, 419.3, 615.1; 226/18, 113

[56] References Cited

U.S. PATENT DOCUMENTS 3,261,566 7/1966 Epstein ..... 242/417.3
5,419,509 5/1995 Krayenhagen ..... 242/419

*Primary Examiner*—John M. Jillions
*Attorney, Agent, or Firm*—Kennedy, Covington, Lobdell & Hickman LLP

[57] ABSTRACT

The present invention provides apparatus for equalizing the tension across the width of a web traveling under tension in a generally flat plane. The apparatus includes a longitudinal extending bladder formed of an elastic material and inflated with a fluid at a predetermined pressure, and a support structure for supporting the bladder beneath the traveling web and across the width thereof so that the bladder is positioned at a predetermined height above the flat plane of the traveling web whereby any variances in the tension across the width of the web will be equalized by the bladder. A plurality of finger elements are mounted to the support structure to extend between the bladder and the traveling web to prevent abrasive wear on the bladder by the traveling web.

5 Claims, 2 Drawing Sheets

APPARATUS FOR EQUALIZING TENSION IN A TRAVELING WEB

BACKGROUND OF THE INVENTION

The present inventions relates generally to an apparatus for equalizing the tension in a web of material, and more particularly to apparatus of the type which is used to equalize variation in tension across the width of a traveling web.

In general, modem apparatus for forming and/or processing webs of material such as paper, fabrics and the like, require that the web have substantial width and that the web travel at a very high speed, all for the purpose of reducing the costs of forming or processing the web on a per unit basis. While these increases in the width and speed of the traveling web enhance manufacturing costs, these same increases also tend to increase variations in the tension across the width of web which, if not equalized or compensated for, can have adverse effects on the forming and/or processing of the web. These tension variations may be caused during the manufacture of the web or mechanically induced while the web is travelling through a variety of processes.

For example, in a typical apparatus for forming a web of paper, the traveling web of paper is passed around and in contact with the surface of a heater roller, and variation in the tension of the traveling web across its width can result in the web being pressed against the surface of the heated roll with unequal forces so that the heat from the heated roll is applied unevenly to the web across its width. Usually the inherent variation in the tension of the web will result in the outermost edge of the web having the least tension so that they tend to flap, but such inherent variation can cause other undesirable results, depending on the type of web being formed or processed (e.g. paper, fabric, etc.), and the particular application, all as is well known to those skilled in the art.

SUMMARY OF THE INVENTION

The present invention relates to an apparatus for equalizing the tension across the width of a web traveling under tension in one direction and in a generally flat plane, and such apparatus includes a longitudinal extending bladder formed of an elastic material and inflated with a fluid at a predetermined pressure. A support structure is provided that extends beneath the traveling web and across the width thereof, and this support structure is formed with a cradle supporting the bladder at a position extending across the width of the traveling web and at a predetermined height above the flat plane of travel of the web so that any variances in the tension of the web across the width thereof exert varying degrees of force against the resilient bladder to generally equalize the tension in the web.

In the preferred embodiment of the present invention, the support structure preferably includes a plurality of finger elements that are formed of a wear resistant material, and each finger is arranged to extend between the surface of the bladder and the traveling web to prevent wear on the bladder by the traveling web. These fingers preferably have a fixed connection to the supporting cradle on one side thereof, and a sliding connection to the support structure on the other side thereof so that the fingers can move with the adjacent surface of the bladder and respond to variations in the tension in the web across the width thereof.

The bladder may be sealed to maintain the fluid therein at a predetermined pressure, or a pressure regulator may be mounted in fluid communication with the interior of the bladder, with the pressure regulator acting in response to variations in the tension forces exerted on the bladder by the traveling web to add fluid to the bladder when the tension force is reduced below a predetermined level and to permit removal of fluid from the bladder when the tension force increases above a predetermined level.

DESCRIPTION OF THE PREFERRED EMBODIMENT

Figure 1:
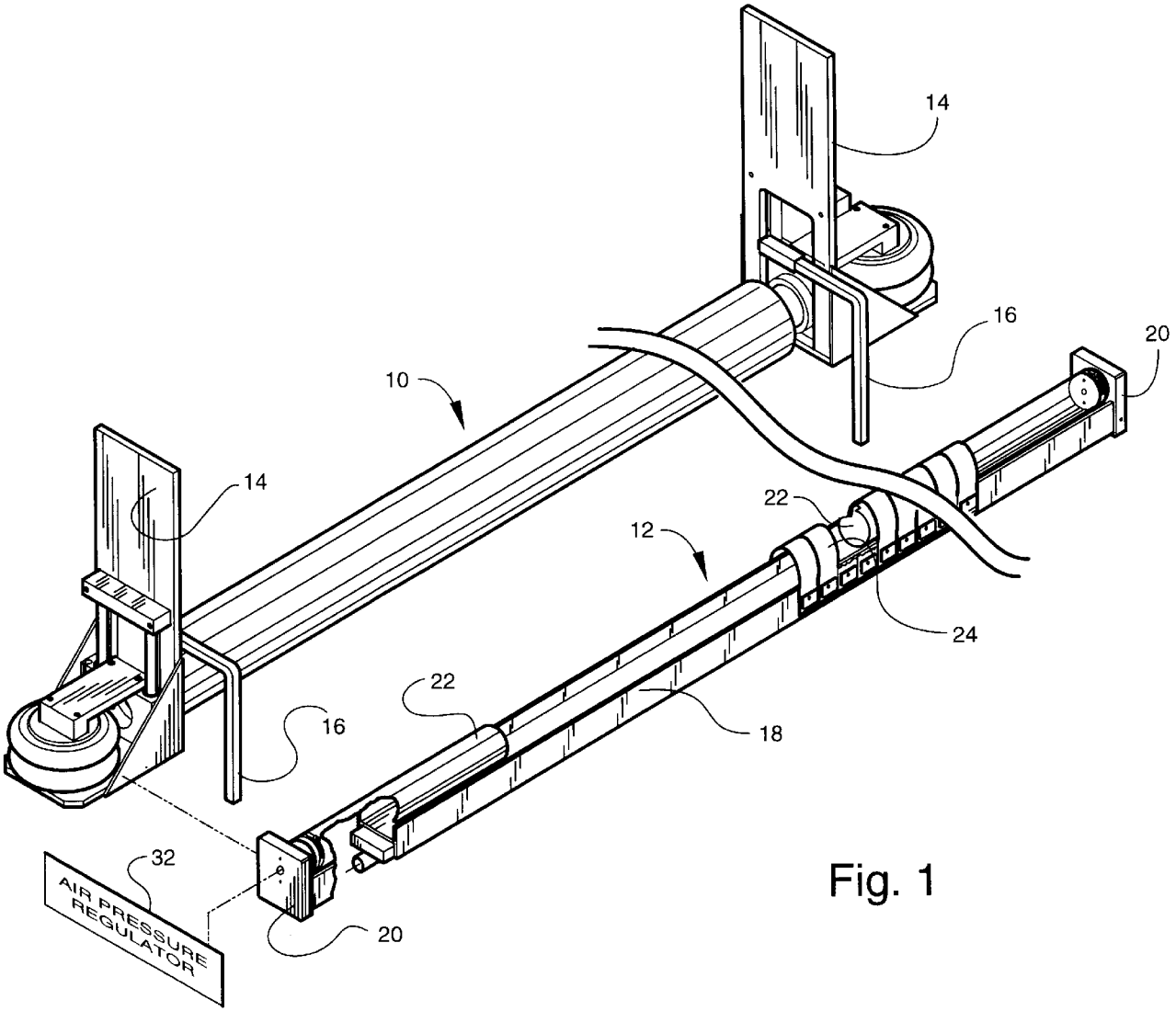
FIG. 1 is perspective view illustrating the tension equalizing apparatus of the present invention located downstream of a web tensioning roll.

Looking now in greater detail at the accompanying drawings, FIG. 1 illustrates a conventional web tensioning roll 10 located downstream of apparatus 12 for equalizing tension in a traveling web in accordance with the present invention. The web tensioning roll 10 may be of the type described in greater detail in Krayenhagen U.S. Pat. No. 5,419,509, but it is expressly understood that the tension equalizing apparatus 12 of the present invention may be used in a wide variety of applications where a web of material is traveling under tension, and the apparatus 10 may be used with virtually any type of web material, such as paper, fabric materials, and similar webs.

In the disclosed embodiment of the present invention, the web tensioning roll 10 is mounted to a frame 14, and a pair of support arms 16 are attached to the frame 14 to support an I-beam 18 that extends transversely between two side plates 20.

Figure 2:
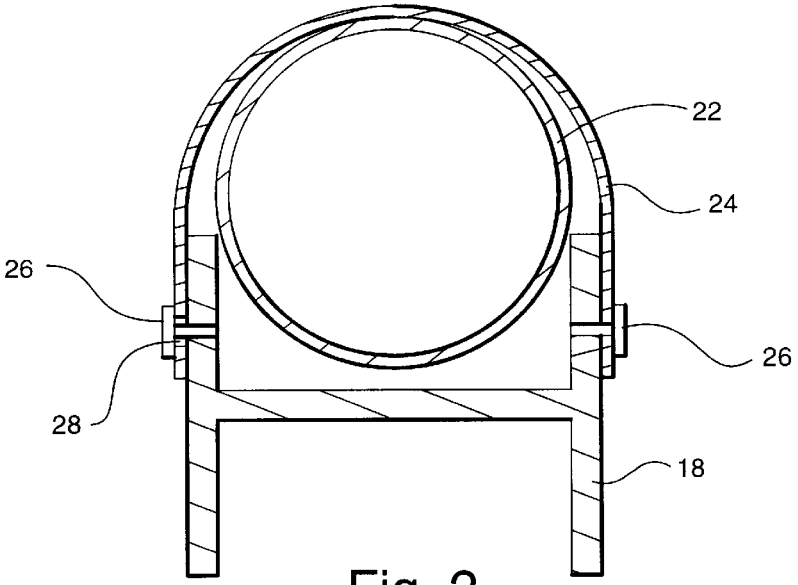
FIG. 2 is a cross-sectional view taken through the I-beam and the bladder.

As best seen in FIGS. 1 and 2, an inflatable bladder 22 formed of any suitable elastic or resilient material, such as rubber, is supported in the upwardly facing channel of the I-beam 18 to extend between a pair of side plates 20. Additionally, a plurality of finger elements 24 are mounted along the extending length of the I-beam 18 in abutting side-by-side relationship (see FIG. 1).

Each finger element 24 is mounted at one end of to the I-beam 18 by fixed connector 26 (see FIG. 2), and the other end of each finger element 24 is movably connected to the other side of the I-beam 18 in sliding relation thereto by a second connector 26 extending through a slot 28 in the other end of the finger element 24. The principal function of these finger elements 24 is to provide an abrasive-resistant material between the traveling web and the bladder 22, which would otherwise be susceptible to excessive wear caused by the abrasive action of a traveling web in surface contact with the resilient material from which the bladder 22 must be made. Accordingly, the finger elements 24 are made from any suitable low friction and high wear material that can be made thin enough to transmit directly the tension forces in the web to the resilient bladder 22, and while there are a number of materials that will give satisfactory results, one particular suitable material is UHMW-PE.

The bladder 22 is filled with a fluid, such as air or a liquid, and in accordance with one embodiment of the present invention, the bladder 22 is preferably filled with air at a pressure of one half psi, and the bladder 22 is then sealed to maintain the pressure within the bladder 22 at that level.

In another embodiment of the present invention, the bladder 22 is provided with an inlet conduit 30 that extends through one of the side walls 20 (see FIG. 1) and that is in fluid communication with a conventional air pressure regulator 32. This conventional air pressure regulator 32, as is well known in the art, may be set at any predetermined air pressure, such as the aforesaid one half psi, and if the pressure within the bladder 22 increases to a level that exceeds the preset level, the air pressure regulator 32 will bleed off some of the fluid within the bladder 22 to thereby reduce the pressure therein until it reaches the preset level. Similarly, if the pressure of the air within the bladder 22 drops below the preset level, the pressure regulator 32 will add fluid to the bladder until the pressure is raised to the preset level. Thus, the pressure regulator 32 actively and automatically maintains the pressure within the bladder 22 at the desired level, such as one-half psi.

Figure 3:
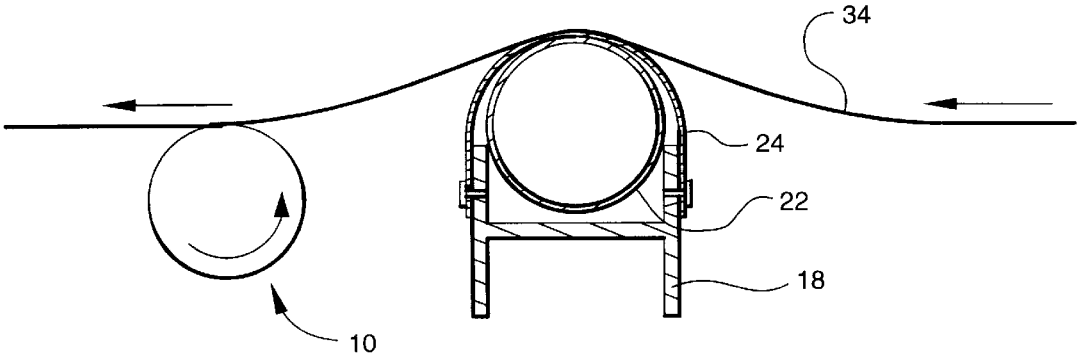
FIG. 3 is a schematic view illustrating the apparatus of the present invention in contact with a traveling web of material.

In operation, as best seen in the diagrammatic illustration in FIG. 3, a traveling web of material, which is either being formed or is being processed in some manner, moves in a flat plane, such as across the web tensioning roll 10, the flat plane being generally tangential to the web tensioning roll 10, and the traveling web 34 is under significant tension, which may vary significantly across the width of the traveling web 34. As discussed above, if this variation in tension across the width of the web is not equalized or compensated for, it can have serious adverse effects, particularly at the outer most edges of the traveling web 34.

In accordance with the present invention, the web tension equalizing apparatus 12 of the present invention is positioned in the path of the traveling web 34, and, importantly, it is positioned so that the bladder 22 extends substantially above the aforesaid normal flat plane of the traveling web 34, as best illustrated in FIG. 3. The positioning of the bladder 22 above the normal flat plane of the traveling web 34 will vary from application to application of the present invention. In one typical application, where the traveling web 34 is paper that is being subjected to heat through contact with a heated roll (not shown) downstream of the apparatus 12, the I-beam 18 is positioned at a location with its upper edge being located one-half inch below the normal plane of travel of the web 34, and the dimensions of the bladder 22 are such that it extends two inches above the upper edge of the I-beam 18.

Figure 4:
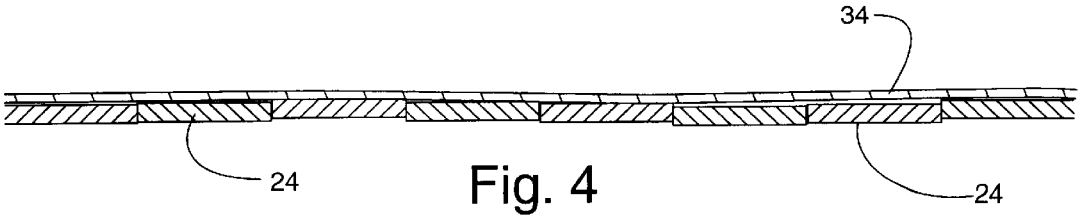
FIG. 4 is a diagrammatic view, somewhat exaggerated, illustrating the traveling web exerting tension forces on the bladder.

As best seen in FIG. 4, which is a schematic and somewhat exaggerated view taken in a vertical plane transverse to the direction of the traveling web 34 and the bladder 22, it will be apparent that any variations in tension across the width of the traveling web 34 will exert varying degrees of force on the resilient bladder 22, which will result in a shifting of the fluid within the bladder 22 to equalize the tension across the width of the traveling web 34. If, for example, the tension at the outer edges of the traveling web 34 is less than the tension in the center section o f the traveling web 34, the higher tension at the central portion of the traveling web 34 will cause fluid to shift from the corresponding central portion of the bladder 22 to reduce the tension in the web thereat and to simultaneously increase the tension at the outermost edges of the traveling web 34. In a similar manner, any variation in the tension across the width of the web will have a similar effect, and such variations will tend to be equalized by the bladder 22.

It will therefore be readily understood by those persons skilled in the art that the present invention is susceptible of broad utility and application. Many embodiments and adaptations of the present invention other than those herein described, as well as many variations, modifications, and equivalent arrangements will be apparent from or reasonably suggested by the present invention and the foregoing description thereof, without departing from the substance or scope of the present. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalents arrangements, the present invention being limited only by the claims appended hereto and the equivalents thereof.

I claim:

1. An apparatus for equalizing the tension across the width of a web traveling under tension in one direction in a generally flat plane, said apparatus including (a) a longitudinally extending bladder formed of an elastic material and inflated with a fluid at a predetermined pressure; and (b) a support structure extending beneath said traveling web and across the width thereof, such support structure being formed with a cradle supporting said bladder at a position extending across the width of the traveling web and at a predetermined height above said flat plane of travel so that any variances in the tension of said web across the width thereof exert varying degrees of force against said resilient bladder to generally equalize the tension in said web.

2. An apparatus for equalizing the tension in a travelling web as defined in claim 1, where said support structure includes a plurality of finger elements formed of a wear resistant material, each of said fingers being arranged to extend between the surface of said bladder and said traveling web to prevent wear on said bladder by said traveling web.

3. An apparatus for equalizing the tension in a traversing web as defined in claim 2 wherein said fingers have a fixed connection to said supporting structure cradle on one side thereof, and a sliding connection to said supporting structure at the other side thereof which said fingers can move with the adjacent surface of said bladder in response to variations in said tension in said web across the width thereof.

4. An apparatus for equalizing the tension in a traversing web as defined in claim 1, wherein said bladder is sealed to maintain said fluid therein at said predetermined pressure.

5. An apparatus for equalizing the tension in a traversing web as defined claim 1, wherein a pressure regulator is mounted in fluid communication with the interior of said bladder, said pressure regulator acting in response to variations in said tension forces exerted on said bladder by said traveling web to add fluid to said bladder when said tension force is reduced below a predetermined level and to permit removal of fluid from said bladder when said tension force increases above a predetermined level.

* * * * *